US005821022A

United States Patent [19]

Ohishi et al.

[11] Patent Number: 5,821,022

[45] Date of Patent: Oct. 13, 1998

[54] CARRIER FOR DEVELOPING ELECTROSTATIC LATENT IMAGE, ELECTROSTATIC LATENT IMAGE DEVELOPER, METHOD FOR FORMING IMAGE AND IMAGE FORMING APPARATUS

[75] Inventors: Kaori Ohishi; Susumu Yoshino; Satoshi Inoue; Chiaki Suzuki; Sueko Sakai, all of Minami-Ashigara, Japan

[73] Assignee: Fuji Xerox Co., Inc. Ltd., Tokyo, Japan

[21] Appl. No.: 858,504

[22] Filed: May 19, 1997

[30] Foreign Application Priority Data

May 28, 1996 [JP] Japan ..... 8-133704

[51] Int. Cl.[6] ..... G03G 9/10

[52] U.S. Cl. ..... 430/108; 430/137

[58] Field of Search ..... 430/108, 137, 430/106

[56] References Cited

U.S. PATENT DOCUMENTS

| | | | |
|---|---|---|---|
| 5,376,488 | 12/1994 | Ohmura et al. | 430/108 |
| 5,604,069 | 2/1997 | Wilson et al. | 430/108 |
| 5,627,001 | 5/1997 | Vail | 430/108 |

FOREIGN PATENT DOCUMENTS

| | | |
|---|---|---|
| A-61-80161 | 4/1986 | Japan . |
| A-61-80162 | 4/1986 | Japan . |
| A-61-80163 | 4/1986 | Japan . |
| A-175769 | 6/1992 | Japan . |
| A-5-61263 | 3/1993 | Japan . |

*Primary Examiner*—John Goodrow
*Attorney, Agent, or Firm*—Oliff & Berridge, PLC

[57] ABSTRACT

A carrier for developing an electrostatic latent image comprising a core material coated with a resin layer, wherein the F/N ratio of the surface of the resin layer ranges from 1 to 20. It is desirable that the resin layer include resin particles containing a nitrogen atom, that the average particle diameter of the nitrogen-atom-containing resin be in a range from 0.1 to 2 $\mu$m, that the thickness of the resin layer be in a range from 0.1 to 10 $\mu$m, that the resin layer include an electroconductive material which is in a condition to be dispersed in the resin layer, that the electroconductive material be made of carbon black, and that the average particle diameter of the carrier for developing an electrostatic latent image be in a range from 30 to 150 $\mu$m. The carrier for developing an electrostatic latent image, which is long-lived, provided with a charging capability unchanged over time, and is capable of effectively preventing fogging are provided.

15 Claims, No Drawings

CARRIER FOR DEVELOPING ELECTROSTATIC LATENT IMAGE, ELECTROSTATIC LATENT IMAGE DEVELOPER, METHOD FOR FORMING IMAGE AND IMAGE FORMING APPARATUS

BACKGROUND OF THE INVENTION

1. Field of the Invention

This invention relates to a carrier for developing an electrostatic latent image, an electrostatic latent image developer, a method for forming an image, and an image forming apparatus used in an electrophotographic process and an electrostatic recording process.

2. Description of the Related Art

A method conventionally used in an electrophotographic process comprises using various measures to form an electrostatic latent image on a photoreceptor or an electrostatic recording medium and allowing detective microparticles, called "toner", to stick to the electrostatic latent image, thereby developing the electrostatic latent image. In this method, carrying particles, called "carrier", are mixed with the toner and both the carrier and the toner are subjected to frictional electrification together to provide the toner with an appropriate magnitude of positive or negative charge.

Generally, the carrier is roughly divided into a coated carrier having a layer on the surface thereof and a non-coated carrier having no layer on the surface thereof. The coated carrier is superior in terms of developer life so that various coated carriers have been developed and practiced. The characteristics required of the coated carrier include a function of providing the toner with an appropriate charging capability (charge amount or charge distribution) and a function of maintaining the charging capability for a long period of time. It is therefore very important that the impact resistance and the resistance to friction of the carrier be high and that the charging capability of the toner be unchanged regardless of the changes in environmental conditions such as temperature, humidity, and the like. Because of this, various coated carriers have been proposed.

According to, for example, Japanese Patent Application Laid-Open (JP-A) Nos. 61-80161, 61-80162, and 61-80163, a comparatively long-lived coated carrier can be obtained by coating the surface of a carrier core material with a copolymer of a nitrogen-containing fluorinated alkyl (meth) acrylate and a vinyl-type monomer, or a copolymer of a fluorinated alkyl (meth)acrylate and a nitrogen-containing vinyl-type monomer. On the other hand, according to Japanese Patent Application Laid-Open (JP-A) Nos. 5-61263 and 4-175769, a comparatively long-lived coated carrier can be obtained by coating the surface of a carrier with a compound containing a fluorine-containing block polymer resin and a nitrogen atom in a specific proportion.

However, when the surface of the carrier core material is coated with each of these resins, an amount of the fluorine-type resin is present on the outside of the surface layer, whereas the compound containing nitrogen is maldistributed within the inside of the surface layer. If the carrier produced in the above manner is used for a long period of time, the layer is worn from the surface of the carrier. As a result, the surface composition changes with time and the charging capability also changes with time, resulting in a problem that stable formation of an image of high quality cannot be maintained for a long period of time.

SUMMARY OF THE INVENTION

This invention has been achieved to solve the above problems and has an object of providing a carrier for developing an electrostatic latent image which is very long-lived and resistant to change in charging capability with time.

Another object of the present invention is to provide an electrostatic latent image developer, a method for forming an image, and image forming apparatus, which are capable of forming an image of high quality in stable condition for a long period of time without changes in the charging capability with time.

This invention is based on the following knowledge of the present inventors: Specifically, when the fluorine-to-nitrogen (F/N) ratio of the surface of a resin layer in a coated carrier is defined in a specific range, the above problems can be solved. Accordingly, a carrier for developing an electrostatic latent image, which is long-lived and has a continuously stable charging capability lasting a long time, can be provided.

The above objects can be attained in the present invention by a provision of a carrier for developing an electrostatic latent image comprising coating a core material with a resin layer, wherein the F/N ratio of the surface of the resin layer is in a range from 1 to 20.

In preferred embodiments of the present invention, it is desirable that the resin layer may include nitrogen-atom-containing resin particles;

- it is desirable that the average particle diameter of the nitrogen-atom-containing resin particles be in a range from 0.1 to 2 $\mu$m;
- it is desirable that the thickness of the resin layer be in a range from 0.1 to 10 $\mu$m;
- it is desirable that the resin layer contain an electroconductive material which is in a condition to be dispersed in the resin layer;
- it is desirable that the electroconductive material be carbon black; and
- it is desirable that the average particle diameter of the carrier for developing an electrostatic latent image be in a range from 30 to 150 $\mu$m.

The electrostatic latent image developer of the present invention comprises the carrier for developing an electrostatic latent image of the present invention and a toner.

In preferred embodiments of the present invention, it is desirable that, in the electrostatic latent image developer, the carrier for developing an electrostatic latent image be positively charged and the toner be negatively charged;

- it is desirable that the average particle diameter of the toner be in a range from 3 to 10 $\mu$m; and
- it is desirable that the toner contain a binding resin and that the binding resin contain a linear polyester.

The method of the present invention for forming an image comprising using a developer layer on a developer support to develop an electrostatic latent image on an electrostatic latent image support, wherein the developer is the above-described electrostatic latent image developer of the present invention.

The image forming apparatus of the present invention comprising developing an electrostatic latent image on an electrostatic latent image support in a developer layer on a carrier for a developer, wherein the developer is the above-described electrostatic latent image developer of the present invention.

DESCRIPTION OF THE PREFERRED EMBODIMENTS

The carrier for developing an electrostatic latent image of the present invention comprises coating a core material with a resin layer.

There are no limitations to the type of the core material, and the core material may be optionally selected from, in accordance with objects, for example, magnetic metals such as iron, steel, nickel, and cobalt; magnetic oxides such as ferrite and magnetite; and particles such as glass beads. Among these, the magnetic metals and magnetic oxides are preferable in the case where a magnetic brushing method is used.

The average particle diameter of the core material is usually from 10 to 500 $\mu$m, preferably from 30 to 100 $\mu$m.

The F/N ratio of the surface of the resin layer is in a specific range.

The F/N ratio means the ratio by atomic percent of fluorine atoms to nitrogen atoms contained in the surface of the carrier for developing an electrostatic latent image.

The F/N ratio of the surface of the resin layer is from 1 to 20 , preferably from 2 to 20 , and more preferably from 3 to 20 . Also, the F/N ratio is preferably in the range which may be defined by either any one of the above-described lower limits or any one of the lower limits of the F/N ratio to be defined in the examples described below and by either any one of the above-described upper limits or any one of the upper limits of the F/N ratio to be defined in the examples described below.

If the F/N ratio is less than one, the critical surface tension of the carrier surface becomes high, which causes the occurrence of contamination of the carrier surface with the toner, leading to a reduction in the charging capability to the toner and changes in the charging capability with time. On the other hand, if the F/N ratio exceeds 20, there is a tendency that the capability of providing the toner with a charge is insufficient. In any case, when the F/N ratio is outside of the range of 1–20, the charging capability greatly changes with time so that the capability of providing the toner with a charge changes remarkably with time. Therefore, there is often a case where the formation of an image of high quality cannot be maintained in a stable condition for a long period of time. On the other hand, when the F/N ratio ranges from 1 to 20, the above drawbacks are eliminated so that the charging capability remains unchanged over time and an image of high quality can be formed in a stable condition for a long period of time. An F/N ratio ranging from 2 to 20 is preferable to promote the above effects and an F/N ratio ranging from 3 to 20 is more preferable to further promote these effects even more.

In this invention, it is desirable that the F/N ratio of the inside of the resin layer be in the above F/N ratio range defined for the surface of the carrier. In this case, even if the film is worn from the surface of the carrier, the F/N ratio is kept almost in a fixed range so that a high capability of providing the toner with a charge can be maintained, which is advantageous.

The F/N ratio of the surface of the carrier for developing an electrostatic latent image can be measured by inspecting the surface using an XPS (JPS 80, manufactured by JEOL Ltd.) in the following conditions: X-ray source: MgK$\alpha$; acceleration voltage: 10 kV; emission current: 30 mA; and repetitive measuring number: 5 times. The F/N ratio in this invention was measured in this manner.

The resin layer includes a fluorine atom (F) and a nitrogen atom (N), and also an electroconductive material as required.

The resin layer can be formed using, for example, a fluorine-atom-containing resin and a nitrogen-atom-containing resin, or a resin containing both a fluorine atom and a nitrogen atom. The resin layer is produced, for example, by polymerizing a monomer containing a fluorine atom and a monomer containing a nitrogen atom, and, as required, using other resins, electroconductive materials, and the like.

The fluorine-atom-containing resin has preferably a critical surface tension of 35 dyn/cm or less, and more preferably 30 dyn/cm or less. Also, the critical surface tension is preferably in the range which may be defined by either any one of the above-described upper limits or anyone the upper limits of the critical surface tension to be defined in the examples described below. In addition, the critical surface tension is preferably in the range which may be defined by either any one of the above-described upper limits or any one of the upper limits defined in the examples below and by any one of the lower limits to be defined in the examples described below.

The critical surface tension exceeding 35 dyn/cm is undesirable because contamination of the surface of the carrier for developing an electrostatic latent image cannot be restrained so that the charging capability is reduced and changes in the charging capability with time tend to increase. On the other hand, if the critical surface tension is 35 dyn/cm or less, the above drawbacks are eliminated so that the surface contamination of the carrier for developing an electrostatic latent image can be effectively controlled. Further, the critical surface tension of 30 dyn/cm or less is even more preferable to promote the above effects.

Examples of such a fluorine-atom-containing resin include polyvinyl fluoride ($\gamma c$=28 dyn/cm), polyvinylidene fluoride ($\gamma c$=25 dyn/cm), polytrifluoroethylene ($\gamma c$=22 dyn/cm), polytetrafluoroethylene ($\gamma c$=18 dyn/cm), and polyhexafluoropropylene ($\gamma c$=16 dyn/cm). Other than these compounds, a copolymer of vinylidene fluoride and an acryl monomer, a copolymer of vinyidene fluoride and vinyl fluoride, fluoroterpolymers such as a terpolymer of tetrafluoroethylene, vinylidene fluoride, and a nonfluorinated monomer, perfluoroacrylate copolymers, perfluoroacrylate-hydroxyethyl methacrylate (hereinafter abbreviated as HEMA as the case may be) copolymers, perfluorosulfonylamide copolymers, and the like, which have a critical surface tension of 35 dyn/cm or less.

These compounds may be used either singly or in combinations of two or more. Also, compounds appropriately synthesized or commercially available compounds may be used. Among these, perfluoroacrylate copolymers, perfluoroacrylate-hydroxyethyl methacrylate copolymers, perfluorosulfonylamide copolymers, resins produced by grafting an alkyl acrylate or the like in the above resins, or resins produced by providing the above resin with a reactive group such as a hydroxyl group or the like and cross-linking the resulting resin using a coupling agent, isocyanate, or the like are preferably used in consideration of the compatibility of the resistance to contamination of the carrier surface with the adhesion to the core material.

Though either thermoplastic resins or heat-curable resins can be used as the resin containing a nitrogen atom, the heat-curable resins are preferably used in view of hardness. Examples of the resins containing a nitrogen atom include polyacrylonitrile, polyvinylcarbazole, polyurethane, amino resins, urea-formaldehyde resin, melamine resin, benzoguanamine resins, urea resins, polyamide resins, and styrene-dimethylamino acrylate copolymers (hereinafter abbreviated as St/DMAA as the case may be).

These compounds may be used either singly or in combinations of two or more. Also, compounds appropriately synthesized or commercially available compounds may be used. Among these, melamine resins, styrene-dimethylamino acrylate colpolymers, benzoguanamine resins, urea resins, and polyurethane are preferable in view of wear resistance, and melamine resins and benzoguanamine resins are particularly preferable.

The resin layer may contain the above resins containing a nitrogen atom in any shape to the extent that the F/N ratio of the surface of the resin layer ranges from 1 to 20. However, it is preferable that the resin layer contain resin particulates.

Generally, the nitrogen-atom-containing resin has less mutual solubility with the fluorine-atom-containing resin and tends to localize inside the resin layer. When the nitrogen-atom-containing resin has a particulate shape, the resin disperses in the resin layer uniformly both in the direction of the thickness of the resin layer and in the direction of the tangential line of the surface of the carrier for developing an electrostatic latent image. Therefore, even if the resin layer is worn from the surface as it is used for a long period of time, a fixed surface composition can be always kept, thereby maintaining a high capability of providing the toner with a charge, which is advantageous.

The nitrogen-atom-containing resin particulates are resin particulates prepared by cross-linking a nitrogen-atom-containing resin.

There are no limitations to a method for manufacturing the particulate nitrogen-atom-containing resin and the method may be appropriately selected from known methods according to the object. As the method for manufacturing the particulate nitrogen-atom-containing resin, a suspension polymerization method and an emulsion polymerization method can be used. Other than these methods, included as the method for manufacturing the resin particulates in which a monomer or an oligomer is dispersed into a bad solvent and granulated due to the surface tension thereof while a cross-linking reaction is carried out and a method in which a low molecular component and a cross-linking agent are mixed and reacted by melting and kneading or the like and then pulverized to a specific particle size using wind force, mechanical force, or the like.

The average particle diameter of the particulates of the nitrogen-atom-containing resin is in a range from 0.1 to 2 $\mu$m, preferably from 0.2 to 1 $\mu$m. Also, the average particle diameter is preferably in the range which may be defined by either anyone of the above-described lower limits or any one of the lower limits of the average particle diameter to be defined in the examples described below and by either any one of the above-described upper limits or any one of the upper limits of the average particle diameter to be defined in the examples described below.

If the average particle diameter is less than 0.1 $\mu$m, the dispersibility of the particulates in the resin layer is greatly impaired, whereas if the average particle diameter exceeds 2 $\mu$m, the resin particulates tend to fall away from the resin layer so that its primary functions cannot be maintained. On the other hand, when the average particle diameter is in the above-defined ranges, the above drawbacks are eliminated so that the resin particulates can be uniformly dispersed in the resin layer with ease. When the average particle diameter is in the above preferred range, the resin particulates falls away hardly at all, especially when mechanically stressed in a copying operation, which is advantageous.

In addition, given as preferred examples of the combination of the fluorine-atom-containing resin and the nitrogen-atom-containing resin are a combination of a perfluoroacrylate copolymer and a melamine resin, benzoguanamine resin, urea resin, or styrene-dimethylacrylic acid copolymer; a combination of perfluoroacrylate-hydroxyethyl methacrylate copolymer and a melamine resin; and a combination of a perfluoroacrylate copolymer and an acrylamide resin.

Examples of the fluorine-atom-containing resin and a nitrogen-atom-containing resin include perfluorosulfonylamide copolymer, perfluorinated alkylsulfonylaminoalkyl methacrylate copolymer, and perfluoroacrylate-dimethylacrylamide copolymer. These compounds may be used either singly or in combinations of two or more. Also, compounds appropriately synthesized or commercially available compounds may be used.

Examples of the above other resins include polyolefin type resins such as polyethylene and polypropylene; polyvinyl and polyvinylidene type resins; polystyrene, acryl resins, polyvinyl acetate, polyvinyl alcohol, polyvinyl butyral, polyvinyl chloride, polyvinylcarbazole, polyvinyl ether, and polyvinyl ketone; vinyl chloride-vinyl acetate copolymers; styrene-acrylic acid copolymers; straight silicon resins formed by organosiloxane bonding or modified products of them; polyesters, polycarbonates, phenol resins, and epoxy resins.

These compounds may be used either singly or in combinations of two or more. Also, compounds appropriately synthesized or commercially available compounds may be used. Among these, polystyrene, silicon resins, polycarbonate resins, phenol resins, epoxy resins, and the like are preferable because these compounds have a relatively lower critical surface tension.

There are no limitations to the type of electroconductive materials and their type may be appropriately selected according to the object. Examples of the electroconductive material include metals such as gold, silver, copper, and the like; semiconductive oxides such as carbon black, titanium oxide, zinc oxide, and the like; and materials produced by coating the surface of a compound such as titanium oxide, zinc oxide, barium sulfate, aluminum borate, and potassium titanate powder with tin oxide, carbon black, a metal, or the like.

It is advantageous that the resin layer contain the electroconductive material, which is in a condition so as to be uniformly dispersed in the resin layer, since reproductivity of a solid can be improved and the toner can be electrically charged in a short time.

These compounds may be used either singly or in combinations of two or more. Also, compounds appropriately synthesized or commercially available compounds may be used. Among these, carbon black is preferable in view of the stability in production cost, electroconductivity, and the like.

There are no limitations to the above-mentioned carbon black and known carbon blacks maybe used as the carbon black. It is desirable to use carbon blacks with a DBP oil absorbing rate ranging from 50 to 250 ml/100 g.

The method for forming the resin layer may be appropriately selected from known methods. Examples of the method for forming the resin layer include a dipping method in which the core material is dipped into a resin layer forming liquid, a spraying method in which a resin layer forming liquid is sprayed on the surface of the core material, a fluidized-bed method in which a resin layer forming liquid is sprayed on the core material floated by an air flow, and a kneader coater method in which the core material and a resin layer forming liquid are mixed in a kneader coater followed by the removal of a solvent.

Among these methods, the kneader coater method is preferable. In addition, after the resin layer forming liquid is applied on the core material and the solvent is removed to form the resin layer, the nitrogen-atom-containing resin may be cross-linked to improve the strength and hardness of the resin layer.

The resin layer forming liquid may be a liquid comprising the fluorine-atom-containing resin and the nitrogen-atom-containing resin, and, as required, further the other resin and the electroconductive material, which are dissolved and dispersed in a solvent.

As examples of the solvent, aromatic hydrocarbons such as toluene, xylene, and the like; ketones such as acetone, methyl ethyl ketone, and the like; and ethers such as tetrahydrofuran, dioxane, and the like can be given, although there are no limitations as to the type of the solvent, to the extent that the solvent can dissolve each of the above resins.

The amount of the fluorine-atom-containing resin in the resin layer forming liquid is around 0.5 to 5 parts by weight in 100 parts by weight of the core material, although the amount is different depending on the types and mutual solubility with the nitrogen-atom-containing resin, the film thickness of a coating layer, and the like, so that it is not defined in general.

If the amount of the fluorine-atom-containing resin is less than 0.5 parts by weight, the surface energy of the carrier for developing an electrostatic latent image increases so that the capability of providing the toner with a charge decreases, which is often the cause of fogging, scattering of the toner, and the like. If the amount exceeds 5 parts by weight, carrier particles tend to agglomerate so that a manufacturing yield often tends to decrease. On the other hand, if the amount of the fluorine-atom-containing resin is in the above defined range, the above drawbacks are eliminated, which is advantageous.

The amount of the nitrogen-atom-containing resin in the resin layer forming liquid is around 0.5 to 5 parts by weight in 100 parts by weight of the core material, although the amount is different depending on the types and mutual solubility with the fluorine-atom-containing resin, the charging capability of the toner, the electric charging rate, and the like, so that it is not defined in general.

If the amount of the nitrogen-atom-containing resin is less than 0.5 part by weight, there is a case where the carrier for developing an electrostatic latent image has an insufficient charging capability. On the other hand, if the amount exceeds 5 parts by weight, the F/N ratio of the surface of the carrier is often less than one. Yet further, on the other hand, if the amount of the nitrogen-atom-containing resin is in the above defined range, the above drawbacks are eliminated, which is advantageous.

The amount of the other resin in the resin layer forming liquid is preferably in a range from 0 to 2 parts by weight in 100 parts by weight of the above core material. When the amount of the other resin exceeds 2 parts by weight, the carrier particles tend to agglomerate so that manufacturing yield often tends to be reduced.

The amount of the electroconductive material in the resin layer forming liquid is in a range from 0 to 1.0 parts by weight, more preferably from 0 to 0.4 parts by weight in 100 parts by weight of the above core material.

The thickness of the resin layer is usually in a range from 0.1 to 10 $\mu$m, preferably 0.2 to 3 $\mu$m. Also, the thickness is preferably in the range which may be defined by either any one of the above-described lower limits or any one of the lower limits of the thickness to be defined in the examples described below and by either any one of the above-described upper limits or any one of the upper limits of the thickness to be defined in the examples described below. If the thickness of the resin layer is less than 0.1 $\mu$m, it is often the cause of flaking of a coating layer due to mechanical stress and separation of the particulates of the nitrogen-atom-containing resin. If the thickness of the resin layer exceeds 10 $\mu$m, the carrier particles tend to agglomerate so that manufacturing yield often tends to decrease.

The average particle diameter of the carrier for developing an electrostatic latent image is in a range from 30 to 150 $\mu$m, preferably from 30 to 100 $\mu$m.

The carrier for developing an electrostatic latent image is positively charged due to a nitrogen atom contained in the resin layer. Because of this, when the carrier for developing an electrostatic latent image of the present invention is combined with a toner to prepare an electrostatic latent image developer, it is desirable that the toner be negatively charged. The carrier for developing an electrostatic latent image of the present invention can be suitably used as a carrier for the electrostatic latent image developer of the present invention.

The electrostatic latent image developer comprises the carrier for developing an electrostatic latent image of the present invention and a toner.

There are no limitations as to the types of toner, and the toner may be appropriately selected from toners according to the object. For example, known toners including a binding resin and coloring material, and, as required, further including additives such as a charge controlling agent, fixing adjuvant, or the like can be used.

Examples of the binding resins include monopolymers or copolymers of styrenes such as styrene, chlorostyrene, and the like; mono-olefin such as ethylene, propylene, butylene, isoprene, and the like; vinyl esters such as vinyl acetate, vinyl propionate, vinyl benzoate, and the like; $\alpha$-methylene aliphatic monocarboxylates such as methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate, and the like; vinyl ethers such as vinylmethyl ether, vinylethyl ether, vinylbutyl ether, and the like; and vinyl ketones such as vinylmethyl ketone, vinylhexyl ketone, vinylisopropyl ketone, and the like. Among these, especially typical examples of the binding resins are polystyrene, styrene-alkylacrylate copolymer, styrene-alkylmethacrylate copolymer, styrene-acrylonitril copolymer, styrene-butadiene copolymer, styrene-maleic anhydride copolymer, polyethylene, and polypropylene. Further, polyester, polyurethane, epoxy resin, silicon resin, polyamide, modified rosin, paraffin, waxes, and the like may be used as the binding resin.

Among these, polyesters are preferable. Preferred examples of the polyesters are a linear polyester resin including, as a main monomer component, a condensation polymerization compound composed of bisphenol A and polyvalent aromatic carboxylic acid, and the like.

As the binding resin, resins having the following specifications are desirable: softening point: 90°–150° C.; glass transition point: 50°–70° C.; number average molecular weight: 2,000–6,000; weight-average molecular weight: 8,000–150,000; acid value: 5–30; and hydroxyl value: 5–40.

Examples of the coloring material include carbon black, nigrosine, aniline blue, calcoyl blue, chrome yellow, ultramarine blue, Du Pont oil red, quinoline yellow, methylene blue chloride, phthalocyanine blue, malachite green-oxalate, lamp black, Rose Bengale, C.I. Pigment Red 48:1, C.I. Pigment Red 122, C.I. Pigment Red 57:1, C.I. Pigment Yellow 97, C.I. Pigment Yellow 12, C.I. Pigment Blue 15:1, C.I. Pigment Blue 15:3, and the like.

It is desirable that the toner be negatively charged. It is advantageous to use the negatively charged toner since the toner is capable of keeping more stable negative charge due to a nitrogen atom contained in the resin layer of the carrier for developing an electrostatic latent image.

The average particle diameter of the toner is usually in a range from 3 to 10 $\mu$m, preferably from 4 to 9 $\mu$m.

The method of the present invention for forming an image itself comprises known image forming steps, specifically, a step of forming a latent image on a latent image support, a step of developing the electrostatic latent image on the electrostatic latent image support using a developer layer on a carrier for a developer, a step of transferring the developed toner image on a transferring member, a step of fixing the toner image on the transferring member, and the like. In this method, the electrostatic latent image developer of the present invention is used as the developer.

The method of the present invention for forming an image can be carried out using, for example, the image forming apparatus of the present invention. Incidentally, the above fixing itself can be performed using a known fixing apparatus.

The image forming apparatus of the present invention comprises a means for forming a latent image on a latent image support, a means for developing the electrostatic latent image on the electrostatic latent image support using a developer layer on a carrier for a developer, a means for transferring the developed toner image on a transferring member, a means for fixing the toner image on the transferring member, and the like. In this apparatus, the electrostatic latent image developer of the present invention is used as the developer.

As the image forming apparatus of the present invention, known equipment such as a copy machine, a facsimile machine, or the like essentially using the electrostatic latent image developer of the present invention as the developer may be used.

EXAMPLES

The present invention will be explained in more detail by way of examples, which are not intended to be limiting of the present invention.

Examples 1

Manufacturing of carrier A for developing an electrostatic latent image

| | Parts by weight |
|---|---|
| Ferrite particles<br>Average particle diameter: 50 $\mu$m | 100 |
| Toluene | 14 |
| Perfluoroacrylate copolymer<br>Critical surface tension: 28 dyn/cm, perfluorooctylethyl acrylate/methyl methacrylate copolymer, copolymerization ratio: 60:40, weight-average molecular weight $M_w$: 70,000 | 1.6 |
| Cross-linked melamine resin particles<br>Average particle diameter: 0.3 $\mu$m, insoluble in toluene | 0.25 |
| Carbon black<br>VXC 72, manufactured by Cabot Co., Ltd., oil absorbing rate: 178 ml/100 g | 0.12 |

The above-described components excluding the ferrite particles as the core material were dissolved and dispersed for 10 minutes using a stirrer to prepare a resin layer forming liquid. The resin layer forming liquid and the ferrite particles were placed in a vacuum deaerator type kneader and agitated at 60° C. for 30 minutes according to a kneader-coater method. Toluene was distilled away under reduced pressure in the kneader, thereby forming a resin layer on the ferrite particles to prepare carrier A for developing an electrostatic latent image. Incidentally, in this example, the carbon black diluted in toluene was dispersed in perfluoroacrylate copolymer using a sand mill in advance.

This carrier A for developing an electrostatic latent image was positively charged, having an average particle diameter of 51 $\mu$m, the thickness of a resin layer was 1.0 $\mu$m, and the F/N ratio of the surface of the resin layer was 14.7. Also, it was observed that the cross-linked melamine resin was dispersed in the resin layer of carrier A for developing an electrostatic latent image uniformly both in the direction of the thickness of the resin layer and in the direction of the tangential line of the surface of carrier A for developing an electrostatic latent image.

Example 2

Manufacturing of carrier B for developing an electrostatic latent image

| | Parts by weight |
|---|---|
| Ferrite particles<br>Average particle diameter: 50 $\mu$m | 100 |
| Toluene | 14 |
| Perfluoroacrylate/HEMA copolymer<br>Critical surface tension: 30 dyn/cm, perfluorooctylethyl acrylate/HEMA copolymer, copolymerization ratio: 10:1, weight-average molecular weight $M_w$: 50,000 | 1.6 |
| Butylated melamine | 0.4 |
| Carbon black<br>R330R, manufactured by Cabot Co., Ltd., oil absorbing rate: 70 ml/100 g | 0.10 |

The above-described components excluding the ferrite particles as the core material were dissolved and dispersed for 10 minutes using a homogenizing mixer to prepare a resin layer forming liquid. The resin layer forming liquid and the ferrite particles were placed in a vacuum deaerator type kneader and agitated at 60° C. for 30 minutes according to a kneader-coater method. Toluene was distilled away under reduced pressure in the kneader, thereby forming a resin layer on the ferrite particles. The resulting product was agitated at 150° C. for 60 minutes to cross-link the butylated melamine to prepare carrier B for developing an electrostatic latent image. Incidentally, in this example, the carbon black diluted in toluene was dispersed in perfluoroacrylate copolymer using a sand mill in advance.

This carrier for developing an electrostatic latent image B was positively charged, having an average particle diameter of 51 $\mu$m, the thickness of a resin layer was 1.0 $\mu$m, and the F/N ratio of the surface of the resin layer was 8.61.

Example 3

| Manufacturing of carrier C for developing an electrostatic latent image | Parts by weight |
|---|---|
| Ferrite particles<br>Average particle diameter: 45 μm | 100 |
| Toluene | 14 |
| Perfluoroacrylate copolymer<br>Critical surface tension: 28 dyn/cm, perfluorooctylethyl acrylate/methyl methacrylate copolymer, copolymerization ratio: 40:60, weight-average molecular weight $M_w$: 70,000 | 0.1 |
| St/DMAA copolymer (St/DMAA = 6/4) | 0.7 |

The above-described components excluding the ferrite particles as the core material were dissolved and dispersed for 10 minutes using a stirrer to prepare a resin layer forming liquid. The resin layer forming liquid and the ferrite particles were placed in a vacuum deaerator type kneader and agitated at 60° C. for 30 minutes according to a kneader-coater method. Toluene was distilled away under reduced pressure in the kneader, thereby forming a resin layer on the ferrite particles to prepare carrier C for developing an electrostatic latent image.

This carrier C for developing an electrostatic latent image was positively charged, having an average particle diameter of 46 μm, the thickness of a resin layer was 0.5 μm, and the F/N ratio of the surface of the resin layer was 2.32.

Example 4

| Manufacturing of carrier D for developing an electrostatic latent image | Parts by weight |
|---|---|
| Ferrite particles<br>Average particle diameter: 45 μm | 100 |
| Toluene | 14 |
| Perfluoroacrylate copolymer<br>Critical surface tension: 28 dyn/cm, perfluorooctylethyl acrylate/n-butyl methacrylate/methyl methacrylate copolymer, copolymerization ratio: 4:3:3, weight-average molecular weight $M_w$: 95,000 | 0.5 |
| Benzoguanamine | 0.2 |
| Polymethyl methacrylate | 0.3 |

The above-described components excluding the ferrite particles as the core material were dissolved and dispersed for 10 minutes using a stirrer to prepare a resin layer forming liquid. The resin layer forming liquid and the ferrite particles were placed in a vacuum deaerator type kneader and agitated at 60° C. for 30 minutes according to a kneader-coater method. Toluene was distilled away under reduced pressure in the kneader, thereby forming a resin layer on the ferrite particles to prepare carrier D for developing an electrostatic latent image.

This carrier D for developing an electrostatic latent image was positively charged, having an average particle diameter of 46 μm, the thickness of a resin layer was 0.3 μm, and the F/N ratio of the surface of the resin layer was 3.02.

Example 5

| Manufacturing of carrier E for developing an electrostatic latent image | Parts by weight |
|---|---|
| Ferrite particles<br>Average particle diameter: 45 μm | 100 |
| Toluene | 14 |
| Perfluorosulfonylamide copolymer<br>Critical surface tension: 28 dyn/cm, perfluorooctylsulfonylaminoethyl methacrylate/methyl methacrylate copolymer, copolymerization ratio: 50:50, weight-average molecular weight $M_w$: 65,000 | 2.0 |
| Carbon black<br>VXC 72, manufactured by Cabot Co., Ltd., oil absorbing rate: 178 ml/100 g | 0.15 |

The above-described components excluding the ferrite particles as the core material were dissolved and dispersed for 10 minutes using a stirrer to prepare a resin layer forming liquid. The resin layer forming liquid and the ferrite particles were placed in a vacuum deaerator type kneader and agitated at 60° C. for 30 minutes according to a kneader-coater method. Toluene was distilled away under reduced pressure in the kneader, thereby forming a resin layer on the ferrite particles to prepare carrier E for developing an electrostatic latent image. Incidentally, in this example, the carbon black diluted in toluene was dispersed in perfluoroacrylate copolymer, which was a resin layer forming resin, using a sand mill in advance.

This carrier E for developing an electrostatic latent image was positively charged, having an average particle diameter of 46 μm, the thickness of a resin layer was 1.2 μm, and the F/N ratio of the surface of the resin layer was 7.69.

Comparative Example 1

| Manufacturing of carrier F for developing an electrostatic latent image | Parts by weight |
|---|---|
| Ferrite particles<br>Average particle diameter: 45 μm | 100 |
| Toluene | 14 |
| Perfluoroacrylate copolymer<br>Critical surface tension: 28 dyn/cm, perfluorooctylethyl acrylate/methyl methacrylate copolymer, copolymerization ratio: 40:60, weight-average molecular weight $M_w$: 70,000 | 1.5 |
| Butylated melamine | 0.1 |
| Carbon black<br>VXC 72, manufactured by Cabot Co., Ltd., oil absorbing rate: 178 ml/100 g | 0.4 |

The above-described components excluding the ferrite particles as the core material were dissolved and dispersed for 10 minutes using a stirrer to prepare a resin layer forming liquid. The resin layer forming liquid and the ferrite particles were placed in a vacuum deaerator type kneader and agitated at 60° C. for 30 minutes according to a kneader-coater method. Toluene was distilled away under reduced pressure in the kneader, thereby forming a resin layer on the ferrite particles to prepare carrier F for developing an electrostatic latent image. Incidentally, in this example, the carbon black diluted in toluene was dispersed in perfluoroacrylate copolymer, which was a resin layer forming resin, using a sand mill in advance.

This carrier F for developing an electrostatic latent image was positively charged, having an average particle diameter of 46 μm, the thickness of a resin layer was 1.0 μm, and the F/N ratio of the surface of the resin layer was 23.6.

Comparative Example 2

| Manufacturing of carrier G for developing an electrostatic latent image | Parts by weight |
|---|---|
| Ferrite particles<br>Average particle diameter: 45 μm | 100 |
| Toluene | 14 |
| Perfluoroacrylate copolymer<br>Critical surface tension: 28 dyn/cm, perfluorooctylethyl acrylate/methyl methacrylate copolymer, copolymerization ratio: 40:60, weight-average molecular weight $M_w$: 70,000 | 0.5 |
| Urea resin<br>Average particle diameter: 0.3 μm, insoluble in toluene | 1.0 |
| Carbon black<br>VXC 72, manufactured by Cabot Co., Ltd., oil absorbing rate: 178 ml/100 g | 0.4 |

The above-described components excluding the ferrite particles as the core material were dissolved and dispersed for 10 minutes using a stirrer to prepare a resin layer forming liquid. The resin layer forming liquid and the ferrite particles were placed in a vacuum deaerator type kneader and agitated at 60° C. for 30 minutes according to a kneader-coater method. Toluene was distilled away under reduced pressure in the kneader, thereby forming a resin layer on the ferrite particles to prepare carrier G for developing an electrostatic latent image. Incidentally, in this example, the carbon black diluted in toluene was dispersed in perfluoroacrylate copolymer, which was a resin layer forming resin, using a sand mill in advance.

This carrier G for developing an electrostatic latent image was positively charged, having an average particle diameter of 46 μm, the thickness of a resin layer was 1.0 μm, and the F/N ratio of the surface of the resin layer was 0.22.

Example 6

Carrier H for developing an electrostatic latent image

Carrier H for developing an electrostatic latent image was produced in the same manner as in Example 1 except that a cross-linked melamine resin with an average particle diameter of 0.05 μm was used instead of the cross-linked melamine resin used in Example 1. The manufacture of carrier H was more difficult than that of cross-linked melamine resin A in Example 1, because the dispersibility of the cross-linked melamine resin in the resin layer forming liquid was low.

This carrier H for developing an electrostatic latent image was positively charged, having an average particle diameter of 51 μm, the thickness of a resin layer was 1.0 μm, and the F/N ratio of the surface of the resin layer was 14.0.

Also, it was observed that the cross-linked melamine resin was dispersed uniformly in the resin layer of carrier H for developing an electrostatic latent image both in the direction of the thickness of the resin layer and in the direction of the tangential line of the surface of carrier H for developing an electrostatic latent image.

Example 7

Carrier I for developing an electrostatic latent image

Carrier I for developing an electrostatic latent image was produced in the same manner as in Example 1 except that a cross-linked melamine resin with an average particle diameter of 2.2 μm was used instead of the cross-linked melamine resin used in Example 1 and the amount of the perfluoroacrylate resin was altered to 3.2 parts by weight.

This carrier I for developing an electrostatic latent image was positively charged, having an average particle diameter of 51 μm, the thickness of a resin layer was 2.0 μm, and the F/N ratio of the surface of the resin layer was 15.3.

Also, it was observed that the cross-linked melamine resin was dispersed uniformly in the resin layer of carrier I for developing an electrostatic latent image both in the direction of the thickness of the resin layer and in the direction of the tangential line of the surface of carrier I for developing an electrostatic latent image.

One hundred parts by weight of each of the carriers for developing an electrostatic latent image produced in Examples 1–5 and 7, and Comparative Examples 1 and 2, and 6 parts by weight of a toner were mixed to prepare 7 types of electrostatic latent image developers, which were shown as electrostatic latent image developers 1–7 and 1-a corresponding respectively to carriers A–G and I for developing an electrostatic latent image.

In addition, the toner used in these examples was a magenta toner (toner A) of 8 μm particle diameter, which was prepared by the process described below using the following components:

| Manufacturing of toner A | Parts by weight |
|---|---|
| Linear polyester resin<br>Linear polyester prepared from terephthalic acid/ethylene oxide adduct of bisphenol A/cyclohexane dimethanol; $T_g$: 62° C.; $M_n$: 4,000; $M_w$: 35,000; acid value: 12; hydroxyl value: 25 | 100 |
| Magenta pigment<br>C.I. Pigment Red 57 | 3 |

A mixture of the above components was kneaded using an extruder, pulverized using a jet mill, and then dispersed using a pneumatic classifier to prepare magenta toner particles (d50: 8 μm). 0.4 parts by weight of R 972 (silica, manufactured by Japan Aerosil Co., Ltd.) was added to and mixed with the magenta toner particles using a Henshell mixer to obtain a magenta toner (toner A) which was negatively charged.

These electrostatic latent image developers 1–7 and 1-a were tested in taking 10,000 copies using an electrophotographic copying machine (A-Color 630, manufactured by Fuji Xerox Co., Ltd.) at an intermediate temperature under an intermediate humidity (22° C., 55% RH) The charge quantity and the solid densitly were measured at the start of the copying test and after taking 3,000 copies and 10,000 copies to evaluate the fog on the background according to the standard illustrated below. The results are shown in Table 1.

In Table 1, the charge quantity (μC/g) was a value measured by an image analysis using a charge spectrograph (CSG) method. The fog on the background was measured by visual inspection and rated as follows:

○: No fogging, good image condition.

Δ: A slight rate of fogging, practically no problem in image condition.

X: An observable rate of fogging.

XX: Considerable fogging, remarkably coarse image condition.

The solid density was measured by a densitometer (X-rite) and was rated according to the standard below. A solid density of 1.10 or more ensures practical application.

○: The solid density ranged from 1.30 to 1.49.

Δ: The solid density ranged from 1.10 to 1.29.

X: The solid density ranged from 0.90 to 1.09.

XX: The solid density was 0.89 or less.

TABLE 1

| | Resin coated carrier | Carrier F/N ratio | Toner | Developer No. | Start: Charge amount (μC/g) | Start: Solid density Density | Start: Solid density Judgment | Start: Fog on background |
|---|---|---|---|---|---|---|---|---|
| Ex. 1 | A | 14.70 | A | 1 | −20.5 | 1.43 | ○ | ○ |
| Ex. 2 | B | 8.61 | A | 2 | −23.5 | 1.44 | ○ | ○ |
| Ex. 3 | C | 2.32 | A | 3 | −18.2 | 1.38 | ○ | ○ |
| Ex. 4 | D | 3.02 | A | 4 | −25.5 | 1.32 | ○ | ○ |
| Ex. 5 | E | 7.69 | A | 5 | −22.0 | 1.42 | ○ | ○ |
| Comp. Ex. 1 | F | 23.60 | A | 6 | −17.0 | 1.38 | ○ | ○ |
| Comp. Ex. 2 | G | 0.22 | A | 7 | −28.9 | 1.28 | Δ | ○ |
| Ex. 7 | I | 15.30 | A | 1-a | −20.5 | 1.42 | ○ | ○ |

| | After 3,000 copies: Charge amount (μC/g) | After 3,000 copies: Solid density Density | After 3,000 copies: Solid density Judgment | After 3,000 copies: Fog on background | After 10,000 copies: Charge amount (μC/g) | After 10,000 copies: Solid density Density | After 10,000 copies: Solid density Judgment | After 10,000 copies: Fog on background |
|---|---|---|---|---|---|---|---|---|
| Ex. 1 | −22.5 | 1.40 | ○ | ○ | −21.8 | 1.41 | ○ | ○ |
| Ex. 2 | −22.8 | 1.45 | ○ | ○ | −23.4 | 1.46 | ○ | ○ |
| Ex. 3 | −17.5 | 1.40 | ○ | ○ | −16.7 | 1.41 | ○ | ○ |
| Ex. 4 | −26.2 | 1.30 | ○ | ○ | −26.7 | 1.31 | ○ | ○ |
| Ex. 5 | −19.4 | 1.46 | ○ | ○ | −17.2 | 1.38 | ○ | ○ |
| Comp. Ex. 1 | −20.0 | 1.32 | ○ | X | −12.6 | 1.35 | ○ | XX |
| Comp. Ex. 2 | −34.5 | 1.08 | X | ○ | −40.8 | 0.95 | X | ○ |
| Ex. 7 | −18.2 | 1.45 | ○ | ○ | −15.0 | 1.43 | ○ | ○ |

Ex.: Example
Comp. Ex.: Comparative Example

As is clear from the results shown in Table 1, electrostatic latent image developers 1–5 and 1-a were characterized in that the charge amount was substantially unchanged with time, exhibiting stable charge amounts and stable densities. Also, a good-condition image could be formed without any fog on the background. On the other hand, electrostatic latent image developers 6 and 7 had the drawbacks that the amounts of charge greatly changed with time and the image density changed. Also, fog on the background occurred and toner contamination in the apparatus was observable, exhibiting a remarkably coarse image.

With respect to the electrostatic latent image developers 1, 2, and 5 respectively containing electrostatic latent image developing toners A, B, and E containing carbon black, the reproducibility of solid was high and a toner could be charged in a short time.

With respect to electrostatic latent image developer 1-a, there was little fogging and a good-condition image could be formed. However, the change in the amount of charge with time was slightly greater than that of electrostatic latent image developer 1. It was observed that the cross-linked melamine resin particles had fallen away from the resin layer, which was thought to be the cause of the slightly greater change in the amount of charge.

One hundred parts by weight of each of carriers A–E for developing an electrostatic latent image produced in Examples 1–5 and 6 parts by weight of the toner below were mixed to prepare 5 types of electrostatic latent image developers, which were shown as electrostatic latent image developers 8–12 corresponding respectively to carriers A–E for developing an electrostatic latent image.

In addition, the toner used in these examples was a black toner (toner B) of 9 μm particle diameter, which was prepared by the process described below using the following components:

| Manufacturing of toner B | Parts by weight |
|---|---|
| Linear polyester resin<br>Linear polyester prepared from terephthalic acid/ethylene oxide adduct of bisphenol A/cyclohexane dimethanol; Tg: 62° C.; Mn: 4,000; Mw: 35,000; acid value: 12; hydroxyl value: 25 | 100 |
| Carbon black<br>Mogul L, manufactured by Cabot Co., Ltd. | 6 |

A mixture of the above components was kneaded using an extruder, pulverized using a crusher of a bulk crushing type, and then dispersed using a pneumatic classifier to prepare black toner particles (d50:9 μm). 0.4 part by weight of R 972 (silica, manufactured by Japan Aerosil Co., Ltd.) was added to and mixed with the black toner particles using a henshel mixer to obtain a black toner (toner A) which was negatively charged.

These electrostatic latent image developers 8–12 were tested in taking 10,000 copies using an electrophotographic copying machine (A-Color 630, manufactured by Fuji Xerox Co., Ltd.) at an intermediate temperature under an intermediate humidity (22° C., 55% RH). The charge amount and the solid density were measured at the start of the copying test and after taking 3,000 copies and 10,000 copies to evaluate the fog on the background according to the standard illustrated above. The results are shown in Table 2.

In Table 2, the charge amount ($\mu$C/g), the solid density, and the fog on the background are the same as in Table 1.

TABLE 2

| | | | | | Start | | | |
|---|---|---|---|---|---|---|---|---|
| | Resin coated | Carrier F/N | | Developer | Charge amount | Solid density | | Fog on back- |
| Ex. | carrier | ratio | Toner | No. | ($\mu$C/g) | Density | Judgment | ground |
| 1 | A | 14.70 | B | 8 | −20.5 | 1.43 | ○ | ○ |
| 2 | B | 8.61 | B | 9 | −25.8 | 1.42 | ○ | ○ |
| 3 | C | 2.32 | B | 10 | −18.8 | 1.42 | ○ | ○ |
| 4 | D | 3.02 | B | 11 | −22.8 | 1.38 | ○ | ○ |
| 5 | E | 7.69 | B | 12 | −23.0 | 1.41 | ○ | ○ |

| | After 3,000 copies | | | | After 10,000 copies | | | |
|---|---|---|---|---|---|---|---|---|
| | Charge amount | Solid density | | Fog on back- | Charge amount | Solid density | | Fog on back- |
| Ex. | ($\mu$C/g) | Density | Judgment | ground | ($\mu$C/g) | Density | Judgment | ground |
| 1 | −21.3 | 1.40 | ○ | ○ | −23.4 | 1.42 | ○ | ○ |
| 2 | −22.4 | 1.41 | ○ | ○ | −20.5 | 1.38 | ○ | ○ |
| 3 | −17.4 | 1.38 | ○ | ○ | −17.0 | 1.35 | ○ | ○ |
| 4 | −23.9 | 1.37 | ○ | ○ | −22.0 | 1.40 | ○ | ○ |
| 5 | −22.8 | 1.40 | ○ | ○ | −20.2 | 1.35 | ○ | ○ |

Ex.: Example

As is clear from the results shown in Table 2, electrostatic latent image developers 8–12 were characterized in that the charge amount was substantially unchanged with time, exhibiting stable charge amounts and stable solid densities with time. Also, a good-condition image could be formed without any fog on the background.

With respect to electrostatic latent image developers 1, 2, and 5 respectively containing electrostatic latent image developing toners A, B, and E containing carbon black, the reproducibility of solid was high and a toner could be charged in a short time.

Use of the carrier for developing an electrostatic latent image of the present invention ensures forming of a stable and good-condition image for a long period of time, since the carrier for developing an electrostatic latent image of the present invention is long-lived and its charging capability remains unchanged over time. By using the electrostatic latent image developer, the method for forming an image, and the image forming apparatus of the present invention, which use the carrier for developing an electrostatic latent image of the present invention, an image of high quality can be formed in a stable manner over a long period of time.

What is claimed is:

1. A carrier for developing an electrostatic latent image comprising a core material with a resin layer coated thereon, wherein the resin layer comprises a nitrogen-atom-containing resin in particle form and a fluorine-atom-containing resin, wherein an F/N ratio of a surface of the resin layer is in a range of from 1 to 20, and wherein the nitrogen-atom-containing resin is uniformly dispersed in the resin layer.

2. A carrier for developing an electrostatic latent image according to claim 1, wherein the nitrogen-atom-containing resin particles are uniformly dispersed in the resin layer both in a direction of the thickness of the resin layer and in a direction of the tangential line of the surface of the carrier.

3. A carrier for developing an electrostatic latent image according to claim 1, wherein the average particle diameter of the nitrogen-atom-containing resin particles is in a range from 0.1 to 2 $\mu$m.

4. A carrier for developing an electrostatic latent image according to claim 3, wherein the nitrogen-atom-containing resin is at least one resin selected from the group consisting of polyacrylonitrile, polyvinylcarbazole, polyurethane, amino resins, urea-formaldehyde resins, melamine resins, benzoguanamine resins, urea resins, polyamide resins, and styrene-dimethylamino acrylate copolymers.

5. A carrier for developing an electrostatic latent image according to claim 1, wherein the fluorine-atom-containing resin is at least one resin selected from the group consisting of polyvinyl fluoride, polyvinylidene fluoride, polytrifluoroethylene, polytetrafluoroethylene, polyhexafluoropropylene, copolymers of vinylidene fluoride and an acryl monomer, copolymers of vinyidene fluoride and vinyl fluoride, fluoroterpolymers of tetrafluoroethylene, vinylidene fluoride, and a nonfluorinated monomer, perfluoroacrylate copolymers, perfluoroacrylate-hydroxyethyl methacrylate copolymers, and perfluorosulfonylamide copolymers.

6. A carrier for developing an electrostatic latent image according to claim 1, wherein the thickness of the resin layer is in a range from 0.1 to 10 $\mu$m.

7. A carrier for developing an electrostatic latent image according to claim 1, wherein the resin layer includes an electroconductive material which is in a condition to be dispersed in the resin layer.

8. A carrier for developing an electrostatic latent image according to claim 7, wherein the electroconductive material is carbon black.

9. A carrier for developing an electrostatic latent image according to claim 1, wherein the average particle diameter of the carrier for developing an electrostatic latent image is in a range from 30 to 150 $\mu$m.

10. An electrostatic latent image developer comprising:

a carrier for developing an electrostatic latent image comprising a core material coated with a resin layer, wherein the resin layer comprises a nitrogen-atom-containing resin in particle form and a fluorine-atom-containing resin wherein an F/N ratio of a surface of the resin layer is in a range from 1 to 20, and wherein the nitrogen-atom-containing resin is uniformly dispersed in the resin layer, and a toner.

11. An electrostatic latent image developer according to claim 10, wherein the carrier for developing an electrostatic latent image is positively charged and the toner is negatively charged.

12. An electrostatic latent image developer according to claim 10, wherein the average particle diameter of the toner is in a range from 3 to 10 $\mu$m.

13. An electrostatic latent image developer according to claim 10, wherein the toner contains a binding resin and the binding resin contains a linear polyester.

14. A method for forming an image comprising forming an electrostatic latent image on an electrostatic latent image support, and developing the electrostatic latent image with a developer from a developer layer on a carrier , wherein the developer comprises a carrier for developing an electrostatic latent image comprised of a core material coated with a resin layer, wherein the resin layer comprises a nitrogen-atom-containing resin in particle form and a fluorine-atom-containing resin, an F/N ratio of a surface of the resin layer being in a range from 1 to 20, and wherein the nitrogen-atom-containing resin is uniformly dispersed in the resin layer, and a toner.

15. An image forming apparatus comprising a developing mechanism for developing an electrostatic latent image on an electrostatic latent image support in a developer layer on a carrier for a developer, wherein the developer is the electrostatic latent image developer and comprises a carrier for developing an electrostatic latent image comprising a core material coated with a resin layer wherein the resin layer comprises a nitrogen-atom-containing resin in particle form and a fluorine-atom-containing resin, an F/N ratio of a surface of the resin layer being in a range from 1 to 20 and wherein the nitrogen-atom-containing resin is uniformly dispersed in the resin layer, and a toner.

* * * * *